US010490031B1

(12) United States Patent
De Florimonte et al.

(10) Patent No.: US 10,490,031 B1
(45) **Date of Patent: *Nov. 26, 2019**

(54) SYSTEM AND METHOD OF AUGMENTING ELECTRONIC GAMING RESULTS

(71) Applicants: Andrew Ruallan De Florimonte, London (GB); Dan Moses, Lee's Summit, MO (US)

(72) Inventors: Andrew Ruallan De Florimonte, London (GB); Dan Moses, Lee's Summit, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/031,830

(22) Filed: Jul. 10, 2018

Related U.S. Application Data

(63) Continuation of application No. 15/199,610, filed on Jun. 30, 2016, now Pat. No. 10,049,529.

(60) Provisional application No. 62/187,153, filed on Jun. 30, 2015.

(51) Int. Cl.
*G07F 17/32* (2006.01)
*G07F 17/34* (2006.01)

(52) U.S. Cl.
CPC ..... *G07F 17/3295* (2013.01); *G07F 17/3269* (2013.01); *G07F 17/34* (2013.01)

(58) Field of Classification Search
CPC ... G07F 17/3295; G07F 17/3269; G07F 17/34
See application file for complete search history.

(56) References Cited

U.S. PATENT DOCUMENTS

2007/0026956 A1* 2/2007 Pearson ..... A63D 15/20 473/1

* cited by examiner

*Primary Examiner* — Werner G Garner
(74) *Attorney, Agent, or Firm* — Plager Schack LLP; Mark H. Plager; Alexis J. Saenz

(57) ABSTRACT

A system and method augments electronic gaming results using a timer that includes areas indicating a modifier added to the success/failure of an electronic gaming result. A player(s)/user(s) may influence the outcome of their own and/or others success/failure by timing a trigger during a countdown within the timer. Depending on the area of the timer within which the player(s)/user(s) trigger, a percentage modifier is added to the success/failure of a player's result.

10 Claims, 6 Drawing Sheets

FIG.1
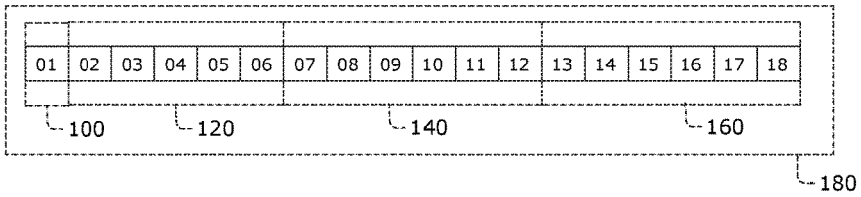
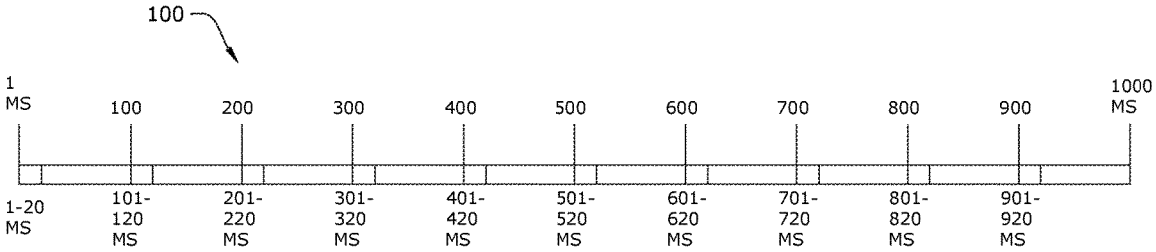
FIG.2

120

100

SYSTEM AND METHOD OF AUGMENTING ELECTRONIC GAMING RESULTS

CROSS REFERENCE TO RELATED APPLICATIONS

This application claims benefit under 35 U.S.C. § 119(e) of U.S. Provisional Application having Ser. No. 62/187,153 filed Jun. 30, 2015, and U.S. application Ser. No. 15/199,610, filed Jun. 30, 2016, which are hereby incorporated by reference in their entirety.

BACKGROUND

Conventional electronic gaming typically relies on random number generation and/or pre-programmed percentages of a "dice roll" to produce results. Thus even skilled based electronic gaming has what some may consider an undesirable amount of luck. For strategy based games, a dice roll is a prevalent element of the game. Thus, while many skilled players understand the probabilities of success with dice rolls, inevitably, their skill may be negated by random unfavorable luck.

As can be seen there is a need for a process that adds skill back into the "dice roll" element of gaming.

SUMMARY

In one aspect, a computer program product is disclosed for augmenting electronic gaming results. The computer program product comprises a non-transitory computer readable storage medium having computer readable program code embodied therewith. The computer readable program code is configured to, when executed by a computer processing unit: determine a desired electronic gaming result for a player; provide an electronic countdown timer for visual display to the player; receive a player triggered action in response to a countdown of the countdown timer; determine an area of the electronic countdown timer coinciding with the player triggered action; read a percentage modifier associated with the determined area; and generate an actual electronic gaming result visually displayed to the player, wherein the actual electronic gaming result is based on the percentage modifier being applied to a probability of outcome of the desired electronic gaming result.

In another aspect, a computer program product is disclosed for augmenting electronic gaming results. The computer program product comprises a non-transitory computer readable storage medium having computer readable program code embodied therewith. The computer readable program code is configured to, when executed by a computer processing unit: determine a desired electronic gaming result for a first player during a turn of the first player in an electronic gaming action involving at least the first player and a second player; provide an electronic countdown timer for visual display to the first player and the second player; receive a player triggered action from both the first player and the second player in response to a countdown of the countdown timer; determine a first area of the electronic countdown timer coinciding with the triggered action from the first player; determine a second area of the electronic countdown timer coinciding with the triggered action from the second player; determine whether the triggered action from the first player or the triggered action from the second player registered last within the electronic countdown timer; read a percentage modifier associated with the determined area associated with the triggered action that registered last within the electronic countdown timer from the first player or the second player; and generate an actual electronic gaming result visually displayed to the first player, wherein the actual electronic gaming result is based on the percentage modifier being applied to a probability of outcome of the desired electronic gaming result.

BRIEF DESCRIPTION OF THE FIGURES

The detailed description of some embodiments of the invention is made below with reference to the accompanying figures, wherein like numerals represent corresponding parts of the figures.

FIG. 1 is a diagram of timer showing areas indicating a percentage modifier added to a "dice roll" according to an embodiment of the subject technology.

FIG. 2 is a diagram of a final second and time ranges within the final second that affect the "dice roll" in the timer of FIG. 1 according to an embodiment of the subject technology.

DETAILED DESCRIPTION OF CERTAIN EMBODIMENTS

Figure 3:
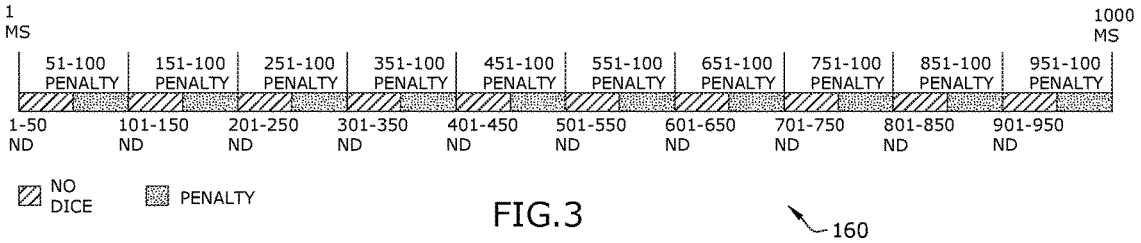
FIG. 3 is a diagram of time ranges and probability effects affecting a "dice roll" as a result of pressed play in the 7-12 second range of the timer of FIG. 1 according to an embodiment of the subject technology.

In general, embodiments of the disclosed subject technology address the problems associated with electronic gaming systems that lack an element providing direct player influence and skill into the results of a player's turn. Embodiments provide a system and process for augmenting results within an electronic gaming platform. The method of control is adaptable to allow players/users to influence outcomes in all number and symbol generated result games. Electronic gaming platforms (for example multiplayer online and standalone) that use electronically generated "dice rolls" (which may be for example randomly generated results or a predetermined die result or dice combination needed for a desired result) to determine a favorable or unfavorable outcome may use aspects of the subject technology to add skill to the "dice roll" portion of gameplay. Embodiments include the use of a countdown timer during which a player(s) times a trigger to register a result influencing the "dice roll" (electronic gaming result). For example, if a player needs to "roll" a result of 6 or less, the player may receive a percentage modifier adding to the success or failure of rolling a 6 or less depending on how well the player times an action on the timer. In some embodiments, a keyboard key(s) or electronic button may represent the player's selected desired outcome. For example, if on a player's turn, he or she needs double 4s for a "dice roll" to have the desired result in the game, then the player will trigger during the countdown by pressing a key/button labeled "4". Likewise, in multi-player games, if an opposing player wants the player whose current turn to roll to have a bad outcome, the opposing player will press a key representing an unfavorable "dice roll" result (for example, a key/button labeled "1" for double 1s). Some embodiments may interpret other key presses for non-double numbers. Also as described further below, non-doubles (mixed dice) may have other results depending on game rules.

Referring now to FIG. 1, an example of an electronic countdown timer 180 that augments a desired electronic gaming result of a "dice roll" for a player is shown according to an exemplary embodiment. The electronic countdown timer 180 (sometimes referred to generally as the "timer 180") may be demarcated into areas 100, 120, 140, and 160 that are associated with a percentage modifier or non-number based result added to the desired result of the player's roll. The timer 180 may include 180 seconds of run-off time. Area 100 may comprise a single last second. Within each area 120, 140, and 160 there may be a multiple seconds in the range. For example, area 120 may comprise the last 2-6 seconds of run-off before the timer 180 hits zero time. Area 140 may comprise the range of 7-12 seconds before zero time is left. Area 160 may comprise 13-18 seconds before zero time is left. Each second of the timer 180 be calibrated to a millisecond. In an exemplary embodiment and as described more fully below, the last player to register a trigger action during a countdown of the timer 180 and within the areas 100, 120, and 140 influences the turn of the current player "rolling dice". Each of areas 100, 120, and 140 may be further subdivided into ranges of milliseconds with each range associated with a different percentage modifier and potential outcome affecting the actual outcome of the dice roll.

In an exemplary embodiment of game play, whichever player is determined to register a trigger action last within the timer 180 has their trigger action influence the "dice roll" by the percentage modifier associated with the point along the timer 180 of the registered trigger. Generally, in an exemplary embodiment, triggering later into the countdown has a better chance of a desired outcome if a player is the last to trigger an action.

Figure 6:
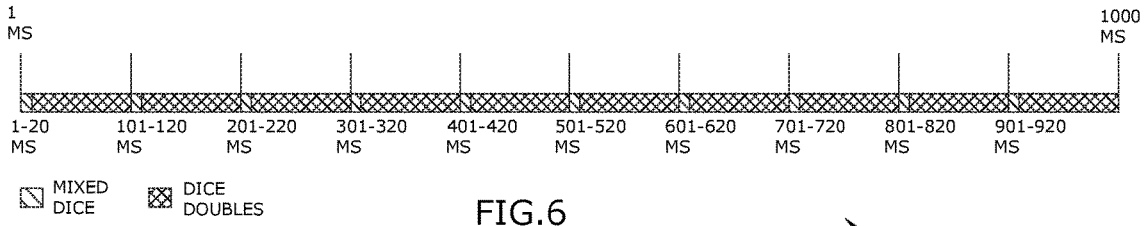
FIG. 6 is a diagram of time ranges and probability effects affecting a "dice roll" as a result of pressed play in the 0-1 second range of the timer of FIG. 1 according to an embodiment of the subject technology

In another exemplary embodiment, ideally players may target triggering within the last second (area 100). For example, referring to FIGS. 2 and 6, area 100 is expanded to show the last 1 second range of the timer 180 subdivided into ranges of milliseconds. Area 100 may in general be associated with a percentage modifier adding for example an 80% chance that the desired outcome is produced by the key/button representing the desired "dice roll" and a 20% chance the "dice roll" is another outcome. In some embodiments, the 20% chance may represent a "mixed dice" outcome which in some games would lead to a number of outcomes but not necessarily the one desired by the player whose key press registered last. As shown in FIG. 2, some embodiments may further subdivide the last second into 20 millisecond and 80 second millisecond ranges associated with the 20% and 80% percentage modifiers respectively. For example, the first 20 milliseconds of each 100 milliseconds may represent the 20% chance of a "mixed dice" outcome or in general not a desired outcome. The next 21-100 milliseconds represent the 80% probability of the key press being the desired result. As might be appreciated, by dividing the area 100 in this manner, randomness is virtually eliminated since the position of the last registered trigger action on the timer 180 determines the actual result. If the trigger action is pressed within one of the 80% ranges, then the desired outcome will be successful as pressed. If the trigger action is registered in one of the 20% ranges, then the desired outcome will not be realized. Moreover, as will be appreciated, the area 100 lowers bias for any particular part of the last second to have more of an 80% or 20% than another by distributing the modifiers throughout the 1000 millisecond range.

Still yet, some embodiments may include conditions governing multiple players registering within the same 1 second block of the timer 180. For example, in the event more than 1 player triggers within the same 1 second block, the last player to trigger within the 1 second block as determined by the millisecond at which they triggered, may be registered for the 1 second block landed in. The earlier triggering players may be bumped into a preceding or proceeding 1 second block (or area 100, 120, 140, 160) which as may be appreciated may have one or more consequences. For example, a bumped player may be pushed into the area 160 thus receiving a penalty or loss of turn. In other situations, bumped players may be pushed out of area 100 beyond the zero mark thus being marked as a player failing to register before the countdown expired and receiving an automatic penalty.

Referring now to FIG. 3, the area 160 may be an area to penalize playing early and may not include a percentage modifier but may result in a direct penalty to the player(s) who trigger within area 160 or may result in no influence on the current dice roll. Each second may be subdivided into ranges of milliseconds that represent a 50% chance of triggering a penalty or 50% chance of not having any influence on the "dice roll". To provide the 50/50 chance of either result, each second of the area 160 may include alternating ranges of fifty millisecond blocks associated with respective aforementioned results. It is understood that while only one second of the area 160 is shown, each second in area 160 may be configured in the above described manner.

Figure 4:
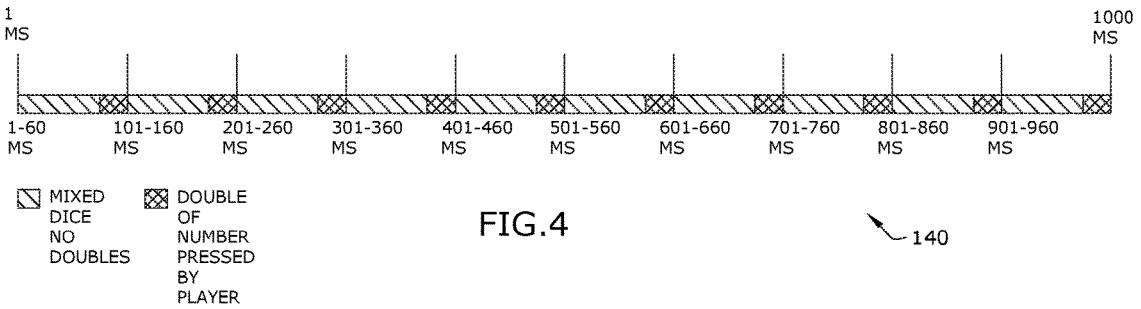
FIG. 4 is a diagram of time ranges and probability effects affecting a "dice roll" as a result of pressed play in the 7-12 second range of the timer of FIG. 1 according to an embodiment of the subject technology.

FIG. 4 shows an expanded view of a one second range within area 140. As will be understood, for sake of illustration only a single second is shown to represent all seconds within the range of area 140. Area 140 may represent a 40% chance of receiving the desired outcome and a 60% chance of another outcome. In the example shown, if the desired outcome is a doubled number then triggering in area 140 has a 40% chance to produce the double number if that player is the last to register a play during countdown or a 60% chance to produce mixed dice. Each second of the time range in area 140 may be subdivided into blocks of 40 milliseconds and 60 milliseconds to provide the 40/60 probability of outcome.

Figure 5:
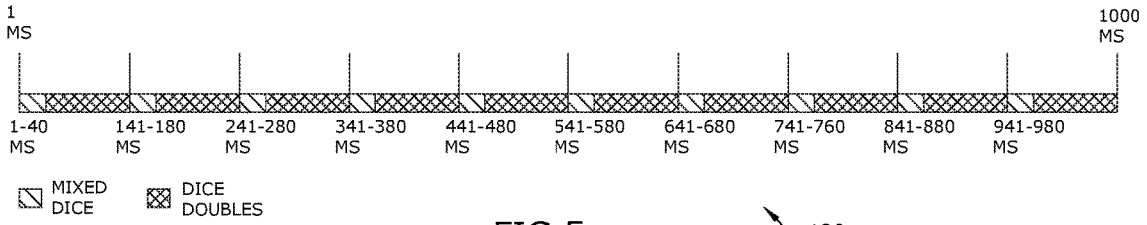
FIG. 5 is a diagram of time ranges and probability effects affecting a "dice roll" as a result of pressed play in the 3-6 second range of the timer of FIG. 1 according to an embodiment of the subject technology.

FIG. 5 shows an expanded view of a one second range within area 120 and is similar to area 140 except the one second ranges are subdivided into blocks representing 60% chance of a desired outcome and 40% chance of another outcome. As shown the desired outcome may be a targeted double number while the 40% outcome may be mixed dice.

Figure 7:
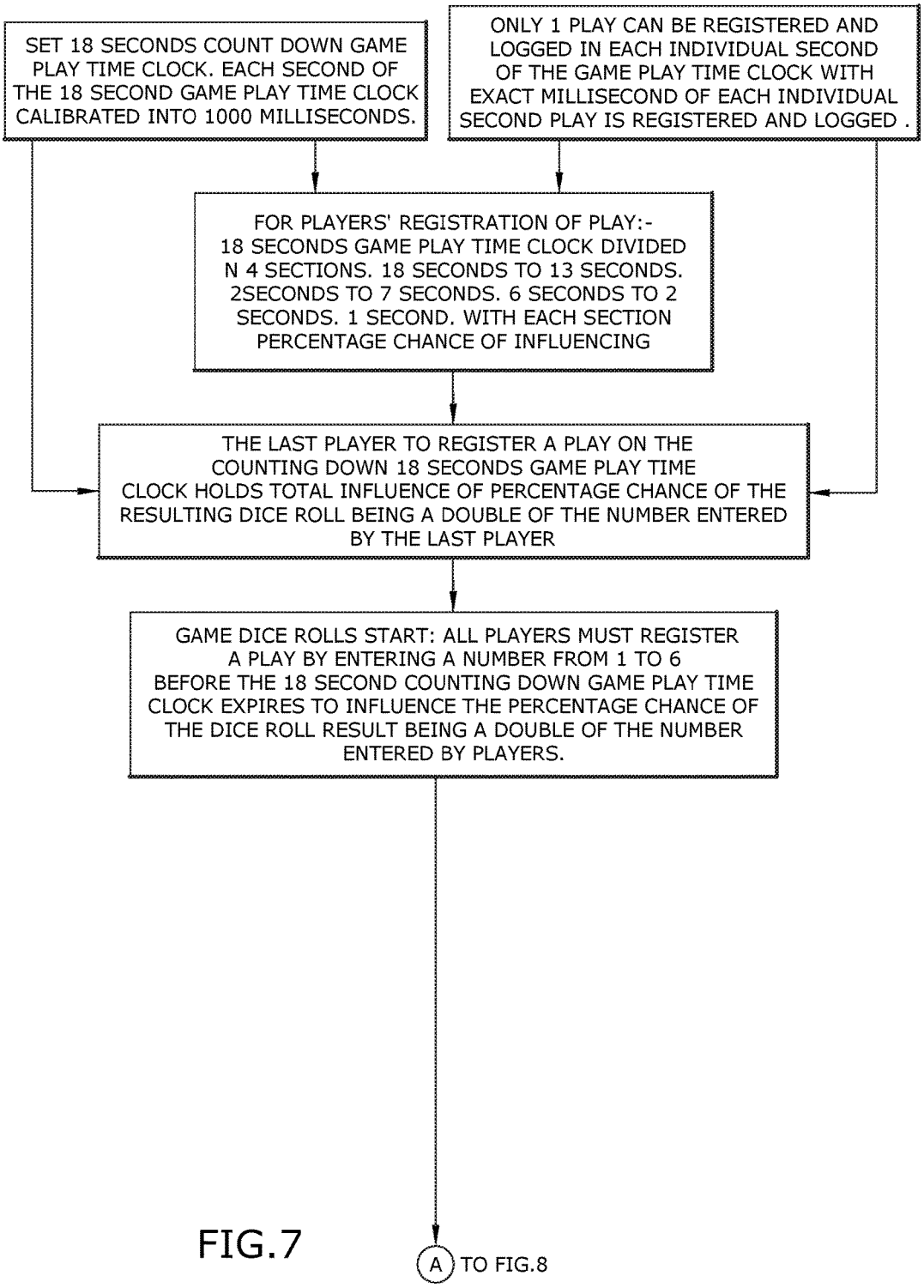
FIGS. 7 and 8 are a flowchart of a method of augmenting electronic gaming results according to an embodiment of the subject technology.
Figure 8:
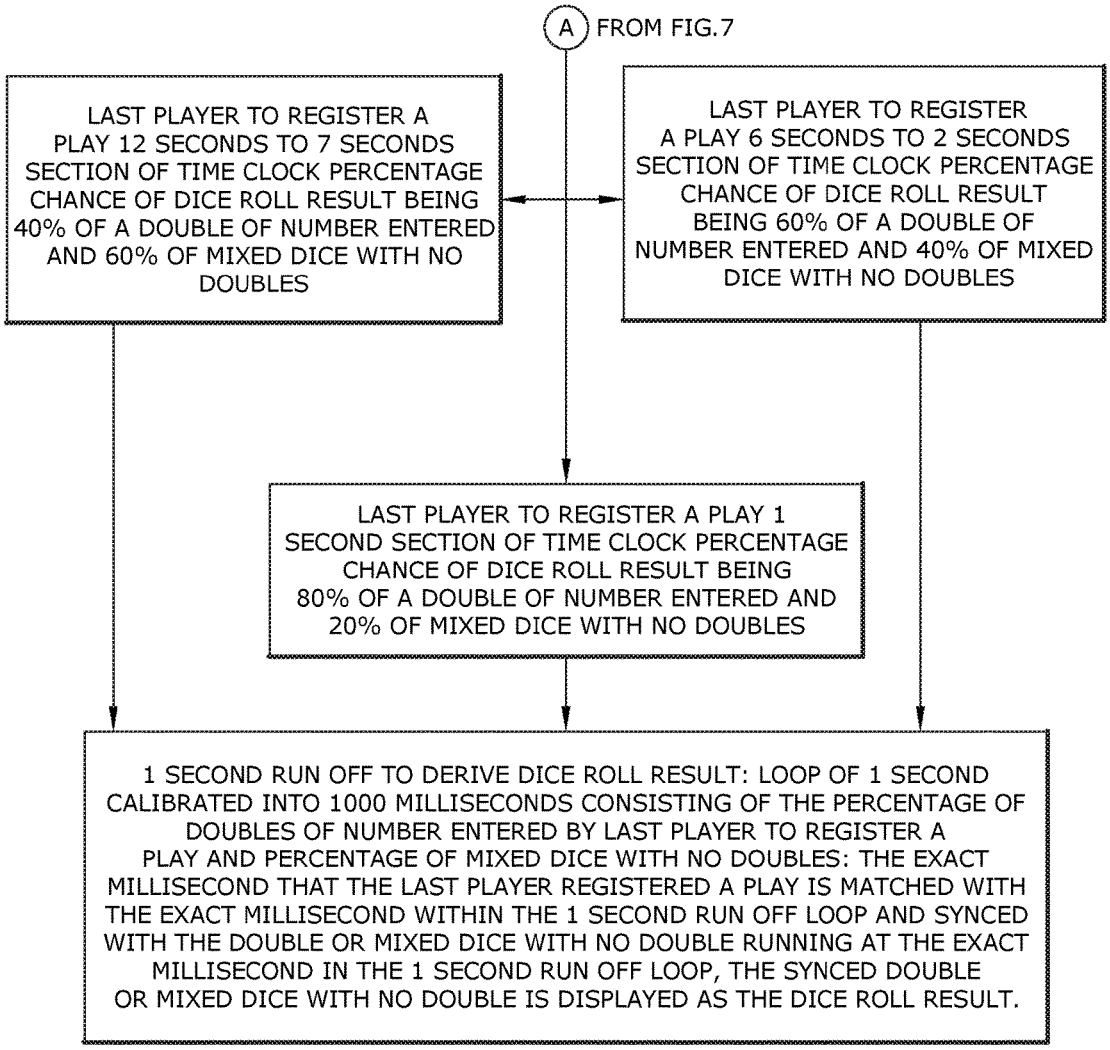

Referring now to FIGS. 7 and 8, a method of electronic gaming control is shown according to an exemplary embodiment. The method incorporates and lends a percentage result chance with transparency to players/users based on how early or late the players/users register their play. An electronic timer is set with a predetermined time range (for example, 18 seconds). As the timer counts down to zero, some embodiments allow more than one player to register within a 1 second block while some embodiments restrict each 1 second block to only a single player. A processor in a computing device providing the electronic timer and game play determines an area of the timer associated with each player triggered action. The processor determines a percentage modifier for the associated area of each registered play. The processor then determines which player registered the last play within the timer and countdown and the associated percentage modifier for that player's action based on the area in which the action was registered. The desired outcome for the last triggering player may then be determined based on the percentage modifier. In some embodiments, the percentage modifier is determined based on the millisecond within the area triggered. Each millisecond may be associated with a percent chance of the player's desired outcome or an associated percent chance of the roll not being the player's desired outcome.

Figure 9:
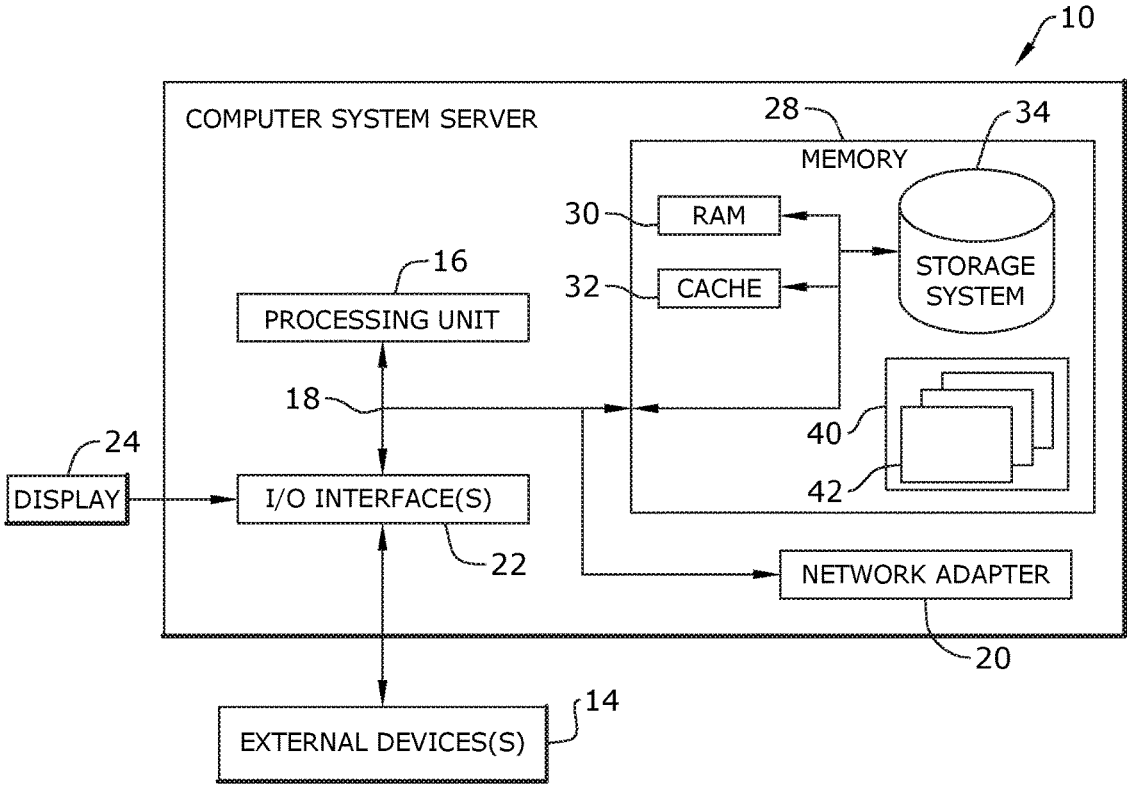
FIG. 9 is a block diagram of a computer system/server according to an embodiment of the subject technology.

Referring now to FIG. 9, a schematic of an example of a computer system/server 10 is shown. The computer system/server 10 is shown in the form of a general-purpose computing device configured to provide embodiments in the form of software providing the electronic gaming platform aspects described above and the features of a player skill influenced electronic generated gaming result. The components of the computer system/server 10 may include, but are not limited to, one or more processors or processing units 16, a system memory 28, and a bus 18 that couples various system components including the system memory 28 to the processor 16. The computer system/server 10 may be for example, PCs, mobile telephone devices, tablet devices, handheld or laptop devices, personal computers, or wearable devices when embodiments are provided as an application being interfaced by the players/users. In some instances, embodiments of the subject technology may use the computer system/server 10 as an intermediary node between users/players. In this capacity, the computer system/server 10 may be a centralized control station hosting electronic gaming platforms using aspects of the system and method disclosed. In this role, the computer system/server 10 may be for example, server computer systems, multiprocessor systems, microprocessor-based systems, network PCs, and distributed cloud computing environments that include any of the above systems or devices, and the like. Thus players may remotely engage in a game against other players via a network of computer systems 10 hosted by server(s) 10 as is known in the art of computer networking.

The computer system/server 10 may be described in the general context of computer system executable instructions, such as program modules, being executed by a computer system (described for example, below). The computer system/server 10 may be practiced in distributed cloud computing environments where tasks are performed by remote processing devices that are linked through a communications network. In a distributed cloud computing environment, program modules may be located in both local and remote computer system storage media including memory storage devices.

The computer system/server 10 may typically include a variety of computer system readable media. Such media could be chosen from any available media that is accessible by the computer system/server 10, including non-transitory, volatile and non-volatile media, removable and non-removable media. The system memory 28 could include one or more computer system readable media in the form of volatile memory, such as a random access memory (RAM) 30 and/or a cache memory 32. By way of example only, a storage system 34 can be provided for reading from and writing to a non-removable, non-volatile magnetic media device. The system memory 28 may include at least one program product 40 having a set (e.g., at least one) of program modules 42 that are configured to carry out the functions of embodiments of the subject technology. The program product/utility 40, having a set (at least one) of program modules 42, may be stored in the system memory 28 by way of example, and not limitation, as well as an operating system, one or more application programs, other program modules, and program data. Each of the operating system, one or more application programs, other program modules, and program data or some combination thereof, may include an implementation of a networking environment. The program modules 42 generally carry out the functions and/or methodologies of embodiments of the invention as described above. For example, the program modules 42 may carry out the steps for providing the gaming platform, providing the electronic timer 180 (FIG. 1) and countdown, registering player actions/presses within the timer 180, identifying desired outcomes from triggered player actions (for example, recognizing key/button presses representing dice rolls), determining areas (100, 120, 140, and 160) of the timer 180 in which play(s) are registered, determining the last player to register a triggered action, providing the "dice roll" results, and determining the augmentation of "dice rolls" based on the percentage modifier for resultant player actions.

The computer system/server 10 may also communicate with one or more external devices 14 such as a keyboard, a pointing device, and/or a touch sensitive display 24, which any or a combination of the keyboard, display, or pointing device may be used by players to register a triggering action. The computer system/server 10 may also communicate with any devices (e.g., network card, modem, etc.) that enable the computer system/server 10 to communicate with one or more other computing devices. Such communication can occur via Input/Output (I/O) interfaces 22. Alternatively, the computer system/server 10 can communicate with one or more networks such as a local area network (LAN), a general wide area network (WAN), and/or a public network (e.g., the Internet or a telephonic wireless network) via a network adapter 20. As depicted, the network adapter 20 may communicate with the other components of the computer system/server 10 via the bus 18.

As will be appreciated by one skilled in the art, aspects of the disclosed invention may be embodied as a system, method or process, or computer program product. Accordingly, aspects of the disclosed invention may take the form of an entirely hardware embodiment, an entirely software embodiment (including firmware, resident software, microcode, etc.) or an embodiment combining software and hardware aspects that may all generally be referred to herein as a "circuit," "module," or "system." Furthermore, aspects of the disclosed technology may take the form of a computer program product embodied in one or more computer readable media having computer readable program code embodied thereon.

Any combination of one or more computer readable media (for example, storage system 34) may be utilized. In the context of this disclosure, a computer readable storage medium may be any tangible or non-transitory medium that can contain, or store a program (for example, the program product 40) for use by or in connection with an instruction execution system, apparatus, or device. A computer readable storage medium may be, for example, but not limited to, an electronic, magnetic, optical, electromagnetic, infrared, or semiconductor system, apparatus, or device, or any suitable combination of the foregoing.

Aspects of the disclosed invention are described above with reference to block diagrams of methods, apparatus (systems) and computer program products according to embodiments of the invention. It will be understood that each block of the block diagrams, and combinations of blocks in the flowchart illustrations and/or block diagrams, can be implemented by computer program instructions. These computer program instructions may be provided to the processor 16 of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above

What is claimed is:

1. A computer program product for augmenting electronic gaming results, the computer program product comprising a non-transitory computer readable storage medium having computer readable program code embodied thereon, the computer readable program code being configured to, when executed by a computer processing unit:

provide an electronic countdown timer for visual display to a first player and to a second player during electronic gaming gameplay, the electronic countdown timer displayed on an electronic gaming user interface, wherein the electronic countdown timer is divided up into a plurality of seconds-based increments, each seconds-based increment is divided up into fractions of a second, and each fraction of a second is associated with a percentage modifier;

register, by the computer processing unit, a first player triggered electronic dice roll based input represented by triggering of a first electronic button being pressed by the first player and a second player triggered electronic dice roll based input represented by triggering of a second electronic button being pressed by the second player, the first electronic button pressed by the first player represents a first value of a desired electronic gaming dice roll result, the second electronic button pressed by the second player represents a second value of the desired electronic gaming dice roll result, and the first player triggered electronic dice roll based input and the second player triggered electronic dice roll based input are received from the first player and from the second player during a same countdown of the electronic countdown timer;

determine a first fraction of a second of the electronic countdown timer coinciding with the first player triggered electronic dice roll based input;

determine a second fraction of a second of the electronic countdown timer coinciding with the second player triggered electronic dice roll based input;

determine whether the first player triggered electronic dice roll based input or the second player triggered electronic dice roll based input registered last within the electronic countdown timer;

read the percentage modifier associated with the first fraction of a second or with the second fraction of a second associated with the first player triggered electronic dice roll based input or with the second player triggered electronic dice roll based input that registered last within the electronic countdown timer from the first player or from the second player;

associate a probability of outcome of the desired electronic gaming dice roll result with the percentage modifier; and generate an actual electronic gaming dice roll result visually displayed in the electronic gaming user interface, wherein the actual electronic gaming dice roll result is based on the desired electronic gaming dice roll result being rolled according to the probability of outcome.

2. The computer program product of claim 1, wherein the percentage modifier increases the probability of outcome for the actual electronic gaming dice roll result being the desired electronic gaming result dice roll result.

3. The computer program product of claim 1, wherein the percentage modifier increases the probability of outcome for the actual electronic gaming dice roll result not being the desired electronic gaming dice roll result.

4. The computer program product of claim 1, wherein each seconds-based increment has a different percentage modifier to be applied to the desired electronic gaming dice roll result.

5. The computer program product of claim 1, wherein each seconds-based increment is divided up to include a first area wherein the percentage modifier increases the probability of outcome for the actual electronic gaming dice roll result being the desired electronic gaming dice roll result and a second area wherein the percentage modifier increases the probability of outcome for the actual electronic gaming dice roll result not being the desired electronic gaming dice roll result.

6. The computer program product of claim 1, wherein seconds-based increments closer to an end of the electronic countdown timer have more fractions of a second with the percentage modifier increasing the probability of outcome for the actual electronic gaming dice roll result being the desired electronic gaming dice roll result than seconds-based increments closer to a beginning of the electronic countdown timer.

7. The computer program product of claim 1, wherein registering the first player triggered electronic dice roll based input or registering the second player triggered electronic dice roll based input within a predetermined seconds-based increment receives a penalty to the desired electronic gaming dice roll result.

8. The computer program product of claim 1, wherein registering the first player triggered electronic dice roll based input or registering the second player triggered electronic dice roll based input within a predetermined seconds-based increment receives a loss of turn.

9. The computer program product of claim 1, wherein the desired electronic gaming dice roll result comprises a rolled double of a number.

10. The computer program product of claim 1, wherein the second player triggered electronic dice roll based input generates a negative outcome for the first player in response to the second player triggered electronic dice roll based input registering last within the electronic countdown timer.

* * * * *